US006638105B1

(12) United States Patent
Wu

(10) Patent No.: US 6,638,105 B1
(45) Date of Patent: Oct. 28, 2003

(54) SELF-RETAINING BOARD LOCK FOR ELECTRICAL CONNECTOR

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/210,599

(22) Filed: Jul. 31, 2002

(51) Int. Cl.[7] ..... H01R 13/60
(52) U.S. Cl. ..... 439/567
(58) Field of Search ..... 439/567, 554, 439/557

(56) References Cited

U.S. PATENT DOCUMENTS 4,124,267 A * 11/1978 Mines et al. ..... 439/553
4,142,810 A * 3/1979 Lesaint ..... 403/252
4,681,389 A 7/1987 Nakazawa et al.
5,074,807 A * 12/1991 Parmer ..... 439/553
5,591,048 A * 1/1997 Hahn ..... 439/567
5,827,089 A * 10/1998 Beck, Jr. ..... 439/567
6,217,378 B1 4/2001 Wu

* cited by examiner

*Primary Examiner*—Lynn Feild
*Assistant Examiner*—Phuong K Dinh
(74) *Attorney, Agent, or Firm*—Wei Te Chung

(57) ABSTRACT

A board lock (17) for securing an electrical connector (1) to a printed circuit board comprises a pair of conjoint parts which is identical but oriented in opposite directions to be mirror images of each other. The pair of conjoint parts comprises a pair of base portions (171) conjoint with each other at upper ends and abuts against each other, a pair of retention portions (172) extending downwardly and transversely from corresponding base portions and partly overlapping each other for engaging with the electrical connector (1), and a pair of legs (175) extending downwardly from corresponding retention portions adapted for engaging with the printed circuit board.

10 Claims, 6 Drawing Sheets

SELF-RETAINING BOARD LOCK FOR ELECTRICAL CONNECTOR

BACKGROUND OF THE INVENTION

1. Field of the Invention

The present invention generally relates to a board lock, and particularly to a self-retaining board lock for use with an electrical connector to be mounted to a printed circuit board (PCB).

2. Description of Related Art

Electrical connectors that connect an external device to a printed circuit board (PCB) are usually fixed to the PCB by means of soldering. To have the soldering operation properly carried out, the electrical connector has to be preliminarily retained in position on the PCB. This is commonly done by means of a board lock which engages with both the electrical connector and the PCB. The retention force between the board lock and a housing of the electrical connector is the key when inserting the board lock into a hole defined in the PCB. If the retention force between the board lock and the housing is insufficient, the board lock will be pushed out from the housing of the electrical connector during its insertion into the PCB hole. Thus, the position of the connector on the PCB cannot be secured. Different board locks are designed to solve the problem described above. Examples of such conventional board locks are disclosed in U.S. Pat. Nos. 4,681,389, 6,217,378 and 5,827,089.

U.S. Pat. No. 5,827,089 discloses a board lock stamped from flat metal stock for disposition in a slot of an electrical connector housing. The board lock includes sharpened barbs formed on resilient legs thereof to prevent the separation of the board lock from a printed circuit board. The board lock is frictionally retained within the housing by action of upper and lower arms which frictionally engage the housing. However, after the resilient upper and lower arms are used for a long time, the friction between the arms and the housing will decrease and may be insufficient to retain the upper and lower arms in the housing.

U.S. Pat. No. 4,681,389 discloses a lock pin for mounting a board-mount type connector on a board. The lock pin comprises an upper lateral arm, a pair of spaced long central legs respectively extending downwardly from the center of the upper lateral arm, and a pair of spaced short outside legs respectively extending downwardly from the upper lateral arm along the outsides of the central legs. The central legs are adapted to be inserted into a lock pin inserting opening of the board. The outside legs have inside projections respectively formed at the lower ends thereof to be engaged with shoulders formed at the peripheries of a pair of inserting openings defined in the connector. The retention force between the board lock and the connector is sufficient through the outside legs which can engage with the connector securely. However, the connector needs to have additional inserting openings and forms shoulders thereon. This increases the cost of the connector and complicates the structure thereof. The dimension of the connector is significantly increased, which is out of the current compact trend.

Hence, it is desired to have a board lock that addresses the problems encountered in the prior art.

SUMMARY OF THE INVENTION

Accordingly, an object of the present invention is to provide a self-retaining board lock for being securely retained in an electrical connector.

Another object of the present invention is to provide an electrical connector comprising the board lock discussed above, which can be retained in on a printed circuit board (PCB).

To achieve the above objects, a board lock in accordance with the present invention comprises a pair of conjoint parts which is identical but oriented in opposite directions to be mirror images of each other. The pair of conjoint parts comprises a pair of base portions conjoint with each other at upper ends and abuts against each other, a pair of retention portions extending downwardly and transversely from corresponding base portions and partly overlapping each other for engaging with an electrical connector, and a pair of legs extending downwardly from corresponding retention portions adapted for engaging with a printed circuit board.

Other objects, advantages and novel features of the invention will become more apparent from the following detailed description when taken in conjunction with the accompanying drawings.

DETAILED DESCRIPTION OF THE INVENTION

Figure 1:
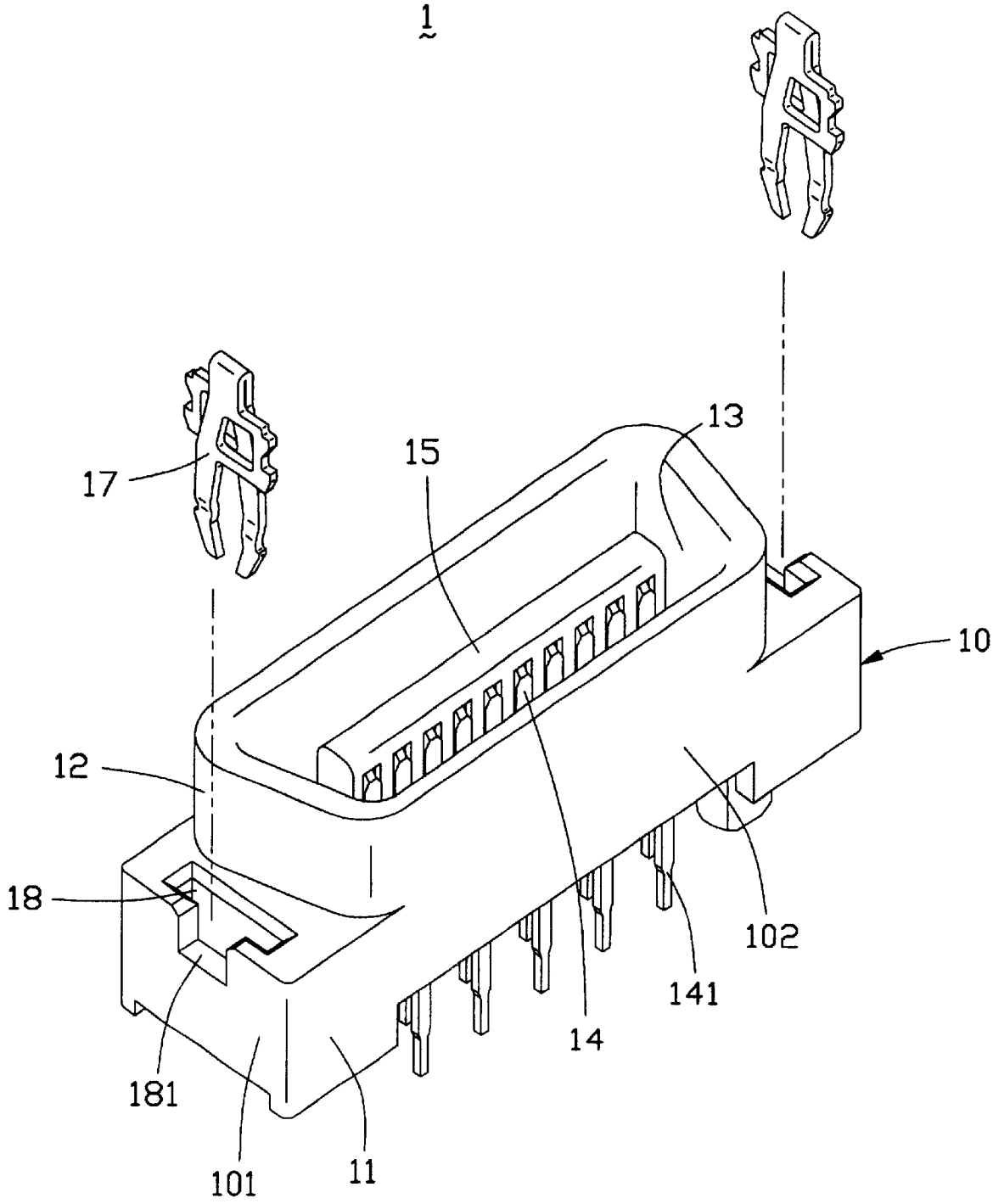
FIG. 1 is an exploded, perspective view of an electrical connector with a pair of board locks in accordance with the present invention.
Figure 2:
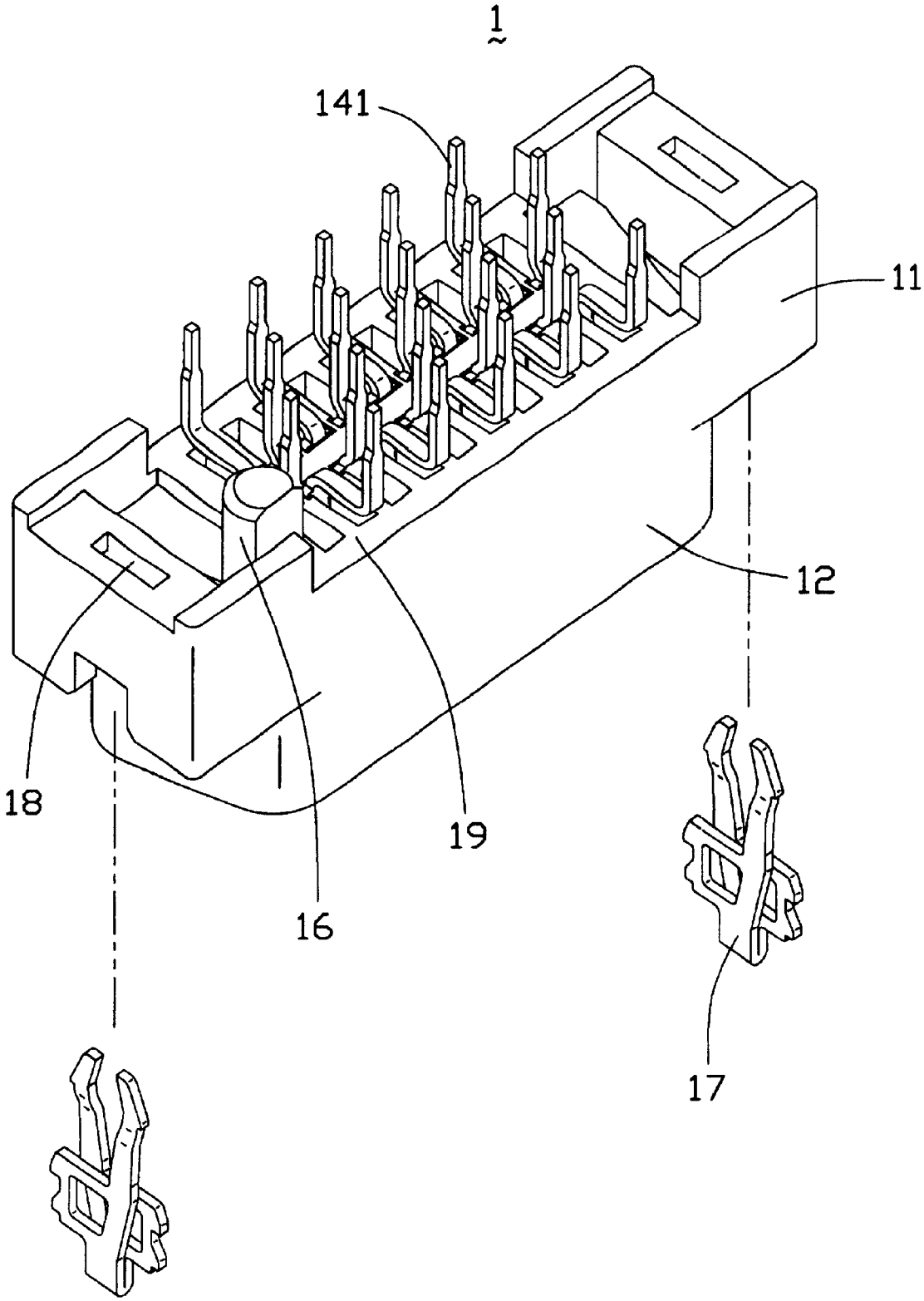
FIG. 2 is an exploded, perspective bottom view of the electrical connector with two board locks in accordance with the present invention.

FIGS. 1 and 2 show a using example of a pair of board locks as an embodiment of this invention illustrating an electrical connector 1 for being fixedly retained on a printed circuit board (not shown) by a pair of board locks 17 of this invention.

A dielectric housing 10 of the electrical connector 1 is a one-piece structure unitarily molded of dielectric material such as plastic or the like. The housing 10 is elongated and includes a base 11 and an upstanding mating frame 12. The base 11 has longitudinally-spaced opposite end portions 101 and laterally-spaced opposite sides 102. The mating frame 12 is of a known D-shaped configuration and defines a D-shaped cavity 13 for receiving a similarly shaped mating plug of a complementary mating connector (not shown). A tongue plate 15 projects into the cavity 13 and retains contacting portions (not labeled) of electrical terminals 14 made of conductive material for electrically engaging the complementary mating connector. Each end portion 101 of the housing 10 defines a slit 18 extending vertically therethrough. A cutout 181 in communication with the slit 18 is defined in a lateral wall (not labeled) of the housing 10. One polarizing post 16 depends from a lower face 19 of the dielectric housing 10 for insertion into a corresponding mounting hole defined in the PCB (not shown). Each terminal 14 has a tail 141 extending beyond the bottom of the housing 10 for solder connection to the PCB.

Figure 3:
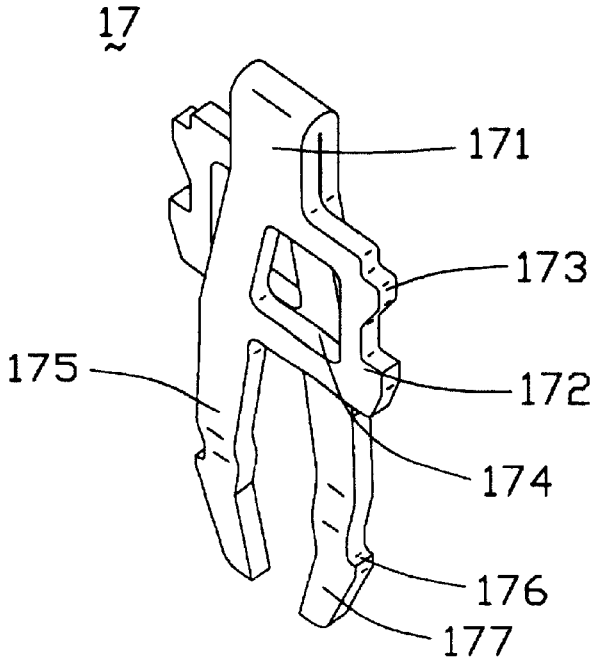
FIG. 3 is a perspective view of the board lock.
Figure 4:
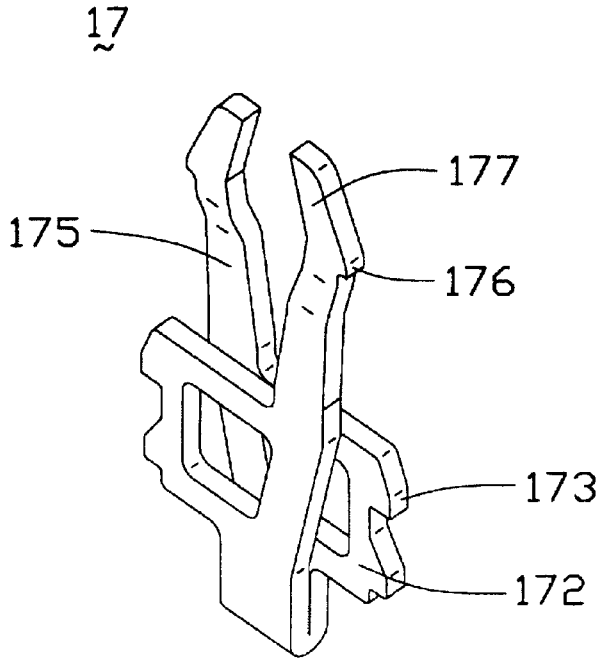
FIG. 4 is a perspective view of the board lock from another angle.
Figure 5:
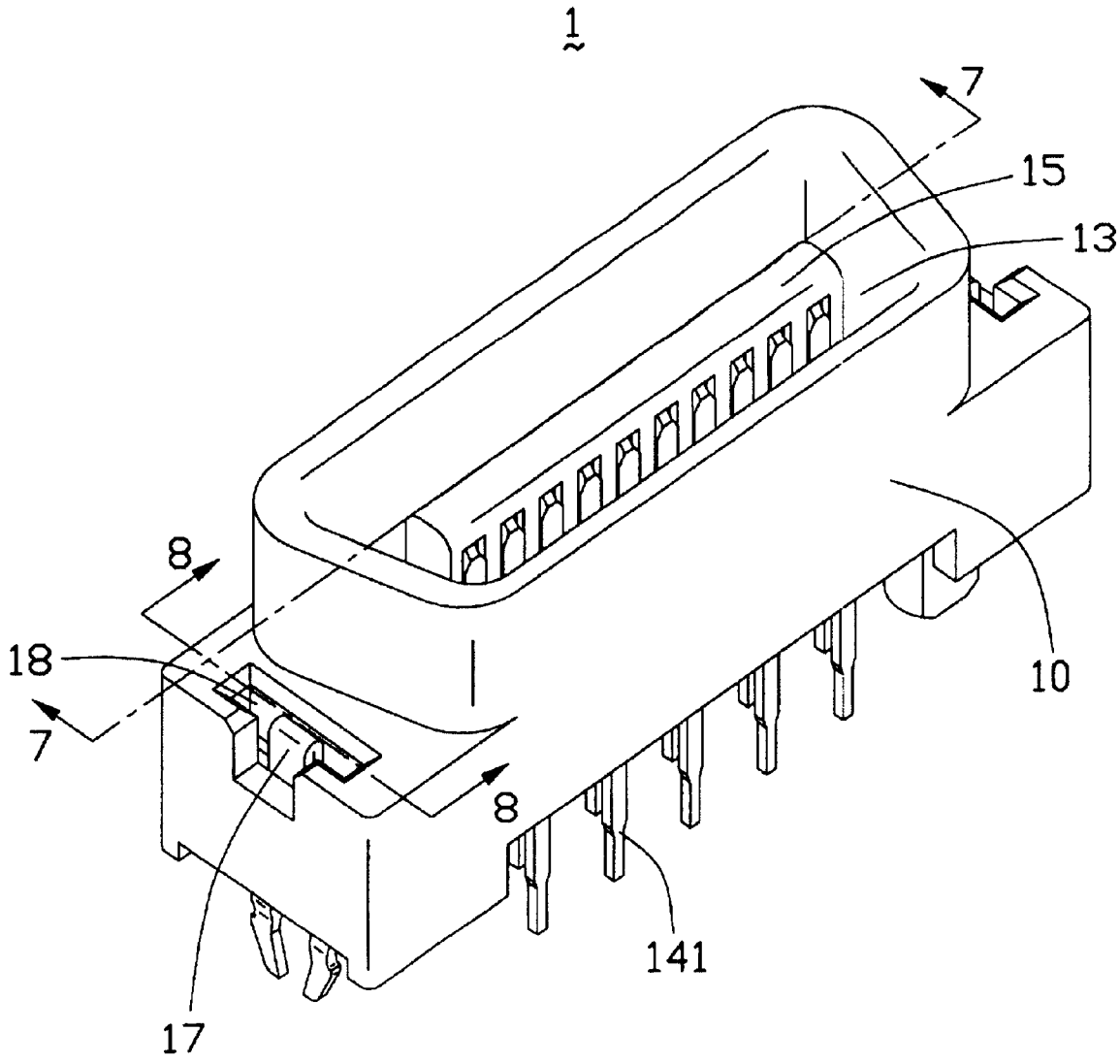
FIG. 5 is an assembled view of FIG. 1.
Figure 6:
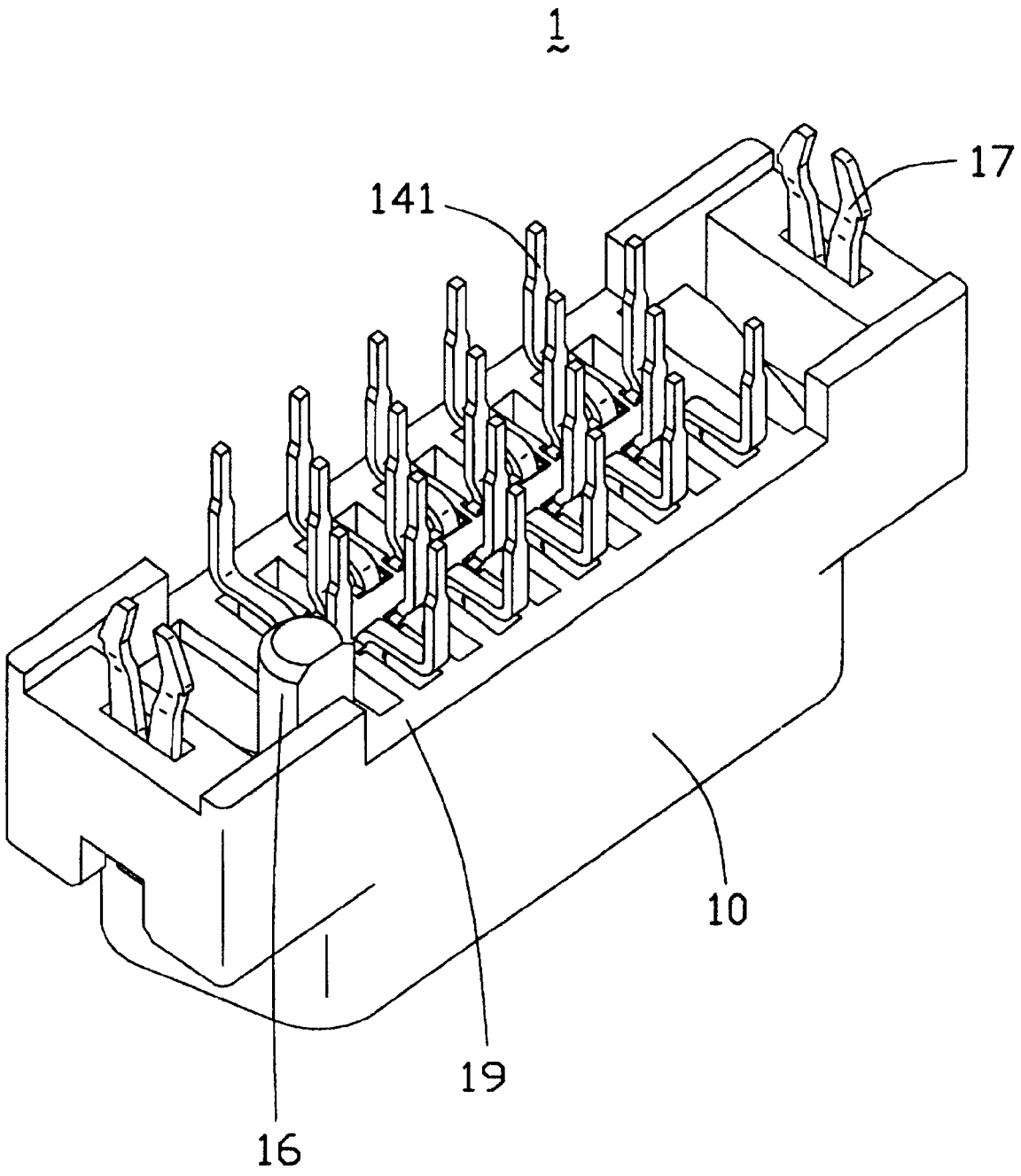
FIG. 6 is an assembled view of FIG. 2.
Figure 7:
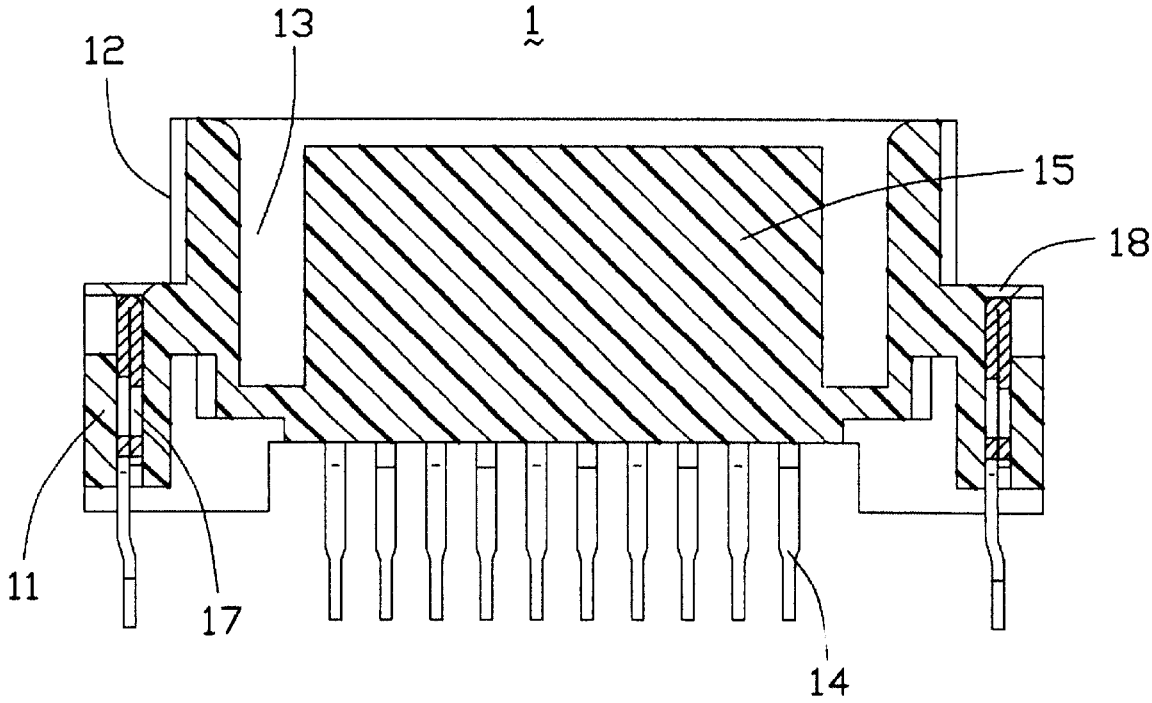
FIG. 7 is a cross sectional view of the electrical connector taken along line 7—7 of FIG. 5.
Figure 8:
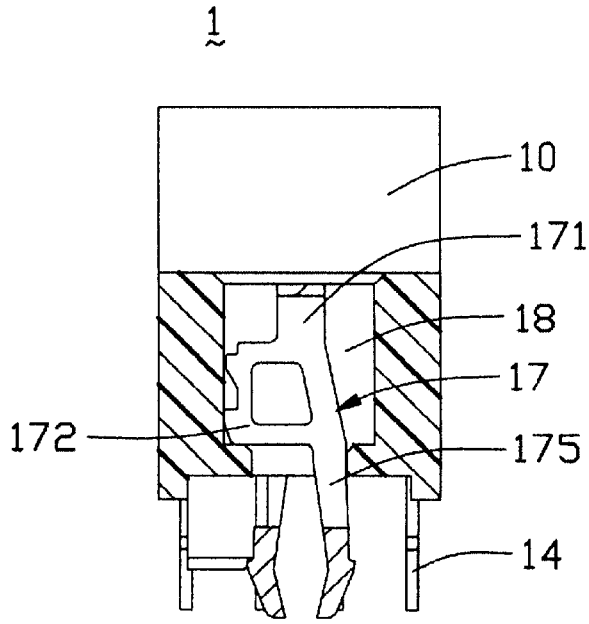
FIG. 8 is a cross sectional view of the electrical connector taken along line 8—8 of FIG. 5.

Now referring to FIGS. 3 and 4, a thorough description of the board lock 17 of this invention will be provided. The board lock 17 of this invention is a one-piece structure stamped from a resilient metal sheet and includes two conjoint parts which are identical but oriented in opposite directions to be mirror images of each other. Each conjoint part of the board lock 17 includes a base portion 171, a retention portion 172 extending downwardly and transversely from the base portion 171, and a resilient leg 175 extending downwardly from the retention portion 172. Each retention portion 172 defines a substantially rectangular hole 174 in the center thereof for providing resiliency. A plurality of retention barbs 173 is disposed on a side edge of the retention portion 172 for engaging with inner walls (not labeled) of the slit 18 of the dielectric housing 10. The leg 175 first slightly bends outwardly and then bends inwardly at a free end 177 thereof. The free end 177 forms an outside projection 176 for engaging a hole defined in the PCB. A gap is defined between the pair of legs 175 for providing room for deflection of the legs 175 when the board lock 17 is being inserted into the PCB hole. The pair of base portions 171 of each board lock 17 is conjoint with each other at upper ends thereof and abuts against each other. The pair of retention portions 172 partly overlaps each other.

Assembly of the board locks 17 of this invention to the electrical connector 1 will now be described in greater detail with reference to FIGS. 5 to 8. The pair of board locks 17 is simply inserted into the slits 18 of the housing 10 with the retention barbs 173 frictionally engaging with the inner walls of the slits 18. The width of the slit 18 is slightly smaller than the original distance between two outer side surfaces (not labeled) of the pair of retention portions 172. The lengthwise dimension of the slit 18 is also slightly smaller than the original distance between two outermost side edges of the pair of retention portions 172. Therefore, during insertion of each board lock 17 into the slit 18, each board lock 17 is pressed by the inner walls of the slit 18, the two partly overlapping retention portions 172 abut against each other closely and the retention barbs 173 frictionally engage with inner end walls of the slit 18. The pair of legs 175 is pressed to align with each other. Thus, the board locks 17 are retentively received in the slits 18. When each board lock 17 is inserted into the PCB hole before soldering, the pair of legs 175 is compressed toward each other by the periphery of the PCB hole, and the pair of retention portions 172 correspondingly extends transversely away from each other to further bite into the inner end walls of the slit 18. Therefore, the board lock 17 is further securely retained in the slit 18, and push-out of the board lock 17 form the slit 18 is efficiently prevented during its insertion into the PCB hole. Accordingly, the position of the electrical connector 1 on the PCB is assured, and the soldering reliability is further ensured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A board lock adapted for securing an electrical connector to a printed circuit board, comprising:

a pair of conjoint parts comprising a pair of base portions conjoint with each other at upper ends thereof, a pair of retention portions extending downwardly from corresponding base portions and adapted for engaging with the electrical connector, and a pair of legs extending downwardly from corresponding retention portions adapted for engaging with the printed circuit board the pair of legs being movable toward each other to decrease a distance therebetween along a direction of movement thereof and to cause a relative movement between the pair of retention portions away from each other along the direction of movement; wherein the pair of conjoint parts of the board lock is identical but oriented in opposite directions to be mirror images of each other; wherein the pair of retention portions of the board lock extend downwardly and transversely from corresponding base portions to partly overlap each other; wherein each retention portion has a plurality of retention barbs formed on a side edge thereof for frictionally engaging with the electrical connector; wherein each leg first slightly bends outwardly and then bends inwardly at a free end thereof; wherein the free end of each leg forms an outside projection adapted for engaging a hole defined in the printed circuit board.

2. The board lock as described in claim 1, wherein the pair of base portions are folded against each other to form an upside-down U-shape.

3. The board lock as described in claim 1, wherein the board lock is stamped from a resilient metal sheet.

4. An electrical connector adapted for being mounted to a printed circuit board, comprising:

a dielectric housing comprising a base and an upstanding mating frame;

a plurality of electrical terminals received in the dielectric housing; and a pair of board locks received in the housing, each board lock having two conjoint parts each comprising a pair of base portions conjoint with each other at upper ends thereof, a pair of retention portions engaging with the electrical connector and a pair of legs extending downwardly from corresponding retention portions adapted for engaging with the printed circuit board, the pair of legs being movable toward each other to decrease a distance along a direction of movement thereof and cause a distance between the pair of retention portion along the direction of movement to increase; wherein the pair of conjoint parts of the board lock is identical but oriented in opposite directions to be mirror images of each other; wherein the retention portion has a plurality of retention barbs formed on a side edge thereof for engaging with inner end walls of the slit of the housing; wherein each leg first slightly bends outwardly and then bends inwardly at a free end thereof; wherein the free end of each leg forms an outside projection adapted for engaging a hole defined in the printed circuit board.

5. The electrical connector as described in claim 4, wherein the base of the dielectric housing is elongated and includes longitudinally-spaced opposite end portions and laterally-spaced opposite sides.

6. The electrical connector as described in claim 4, wherein the mating frame is of a D-shaped configuration and defines a D-shaped cavity.

7. The electrical connector as described in claim 6, wherein the housing comprises a tongue plate projecting into the cavity and retaining contacting portions of the terminals made of conductive materials.

8. The electrical connector as described in claim 5, wherein each end portion of the dielectric housing defines a slit extending vertically therethrough, and the board lock is received in the slit.

9. The electrical connector as described in claim 8, wherein the retention portions of each board lock abut against each other and the pair of legs are pressed by inner walls of the slit to align with each other.

10. The electrical connector as described in claim 8, wherein the width of the slit is slightly smaller than the original distance between outer side surfaces of the pair of retention portions.

* * * * *